US006930679B2

(12) United States Patent
Wu et al.

(10) Patent No.: US 6,930,679 B2
(45) Date of Patent: Aug. 16, 2005

(54) SYSTEM OF LED DRIVERS FOR DRIVING DISPLAY DEVICES

(75) Inventors: Chung-Yo Wu, Hsin-Chu (TW); Chun-Hsung Chang, Tao-Yuan (TW)

(73) Assignee: Macroblock, Inc. (TW)

( * ) Notice: Subject to any disclaimer, the term of this patent is extended or adjusted under 35 U.S.C. 154(b) by 359 days.

(21) Appl. No.: 10/376,933

(22) Filed: Feb. 28, 2003

(65) Prior Publication Data

US 2004/0100459 A1 May 27, 2004

(30) Foreign Application Priority Data

Nov. 22, 2002 (TW) ..... 91134256 A

(51) Int. Cl.[7] ..... G09G 3/00
(52) U.S. Cl. ..... 345/204; 345/82; 345/83
(58) Field of Search ..... 345/204, 82, 83

(56) References Cited

U.S. PATENT DOCUMENTS

2001/0028346 A1 * 10/2001 Kudo et al.
2003/0117382 A1 * 6/2003 Pawlowski et al.
2003/0160771 A1 * 8/2003 Fraser et al.

OTHER PUBLICATIONS

"LCD Control Apparatus & LCD Apparatus," Kudo et al.; U.S. Appl. No. 09/059,363, (Flied: Apr. 14, 1998).*

"Configurable Panel Controller & Flexible Display Interface," Pawlowski et al.; U.S. Appl. No. 10/012,968 (Filed: Dec. 7, 2001).*

"Interchangeable Display Modules for Portable Handheld Devices," Fraser et al.; U.S. Appl. No. 10/085,310, (Filed: Feb. 28, 2002).*

* cited by examiner

*Primary Examiner*—Richard Hjerpe
*Assistant Examiner*—Tammy Pham
(74) *Attorney, Agent, or Firm*—K. David Crockett, Esq.; Crockett & Crockett

(57) ABSTRACT

The present invention discloses a set of devices in cascade for driving display devices. For each of the driving devices, the serial-data-in pin and the serial-data-out pin traditionally used to transfer image data can further deliver commands from and/or internal statuses of the driving devices to an external controller. Accordingly, inventive functions of command transfer and/or status feedback can be achieved without adding extra pins. The present invention also discloses a device suitable for forming the driving set, in which a command register and/or a status register is provided.

13 Claims, 4 Drawing Sheets

SYSTEM OF LED DRIVERS FOR DRIVING DISPLAY DEVICES

FIELD OF THE INVENTION

The present invention relates to a set of devices, which are particularly suitable for driving display devices. The present invention also relates to a driving device suitable for forming the set.

BACKGROUND OF THE INVENTION

Traditionally, sets of LED drivers are applied to driving display devices, e.g. LEDs and VFDs (vacuum fluorescent displays). The display devices are usually placed in matrix, manufactured in a plane, to create and present planar visual information, like images, pictures, and videos. The display devices discretely represent the pixels of the visual information and are driven by the driving devices. By changing the image data which will be stored in the image data register for each discrete pixel sent to the driving device, the visual content displayed can be varied as desired.

To effectively lower the cost of the driving devices, (for example, to lower the package cost of integrated circuit chips), only limited package pins are applied. Using merely five signal pins and the pins of the exact pin count equal to output port count, the image data are sent to the driving devices which then light the display devices. As shown in FIG. 5, no redundant pins are provided.

The driving devices generally comprise of a current-setting circuit 916, N current-output ports 915, N current-output pins, a serial buffer 911 of N bits, and an image data register 914 of N bits.

The serial buffer 911 conventionally works with three signal pins, clock (CLK), serial-data-in (SDI), and serial-data-out (SDO).

When more than one device works in cascade, the CLK pin in all devices are commonly controlled by a set of synchronous signal sources.

The data in the serial buffer 911 can be transferred to the image data register 914 in parallel, and the transfer is triggered by a signal pin, LE!.

When a signal pin, OE!, receives enable signals, the output ports 915 are capable of delivering driving energy (electrical current or voltage), according to the content in the image data register, at least to light the LEDs.

The content in the image data register can be a set of zeros or ones. If ones represent that the LEDs will be lit, zeroes represent that the LEDs will not be lit, and vice versa.

To improve the accuracy, to give more sophisticated control, and to provide the feedback functions, usually more functional circuitry will be designed and manufactured in the driving devices. However, to exploit these added features, more input pins and output pins will always be required.

SUMMARY OF THE INVENTION

An object of the present invention is to provide a set of devices for driving display devices, which performs traditional functions of lighting the display devices and exhibits inventive features of command transfer and/or status feedback without increasing the number of pins needed on the display drivers.

Another object of the present invention is to provide a device for driving display devices, which possesses traditional functions of lighting the display devices in a display mode and exhibits inventive features of command transfer and/or status feedback in a non-display mode without increasing pins.

In this specification, the "display mode" indicates a mode in which the function of lighting the display devices is performed, and the "non-display mode" indicates a mode in which a function other than lighting the display devices is performed. Additionally, the pin described in this specification is not restricted to a pin-shaped means, and can be any lead, element or means capable of receiving or transferring information or data or signals. If the content in the image data register are not to light the LEDs, they are called non-image data. Generally, the non-image data may be the control to be sent to the driving device and may be called command data, and the non-image data may be the feedback to be read from the driving device and may be called status data.

In order to achieve the above objects, each of the driving devices in the set comprises a clock pin, a serial buffer, a serial-data-in (SDI) pin to receive at least image data and a serial-data-out (SDO) pin to transfer at least image data. The clock pin can receive clock signals and make image and/or command and/or status data to be serially shifted to and out from the serial buffer through the SDI pin and the SDO pin. For all of the driving devices, the clock pins are commonly controlled by a set of synchronous signal sources. The driving devices can be connected in cascade and sequentially defined as driving device 1, driving device 2, . . . , driving device P-1, and driving device P; wherein P is an integer larger than 1. Additionally, the SDI pin of the driving device 1 further receives command from an external controller, and the SDO pin thereof further transfers command and/or internal status of the driving device 1. The SDI pin of the driving device 2 further receives command and/or status from the SDO pin of the driving device 1, and the SDO pin thereof further transfers command and/or internal status of the driving devices 1 and 2. Analogically, the SDI pin of the driving device P further receives command and/or status from the SDO pin of the driving device P-1.

In general, when the internal statuses of the driving devices are transferred by SDI pins and SDO pins thereof, status feedback can be further accomplished by connecting the SDO pin of the driving device P with the external controller to form a loop.

In the present invention, the device for driving at least one display device can work in the display mode and the non-display mode. In addition to the serial buffer of N bits, the SDI pin, the SDO pin and the clock pin, the driving device primarily includes at least one extended register of K bits, an image data register of N bits, N output ports, an output-setting circuit, N output pins, a first control pin and a second control pin, wherein N is an integer larger than 1, and K is an integer less than or equal to N.

The output-setting circuit, for example, the current-setting circuit, and the image data register are connected to the output ports. The extended register, when enabled by a correspondent signal in the non-display mode, can transfer status of the driving device to the serial buffer and/or receive command data from the serial buffer. Each of the output pins, for example, the current-output pins, is connected to a corresponding output port, for example, the current-output ports, so as to drive a corresponding display device. The first control pin, for example, the latch-enable pin, is to trigger the serial buffer to transfer data in parallel to the image data register. The second control pin, for example, the output-enable pin, is to enable the output ports to deliver driving energy, electrical current or voltage, to the output pins.

The extended register can be a status register capable of transferring internal status of the driving device to the serial buffer, or a command register capable of receiving command from the serial buffer in the non-display mode.

The correspondent signal for enabling the extended register can be sent from a mode-switch circuit, while the mode-switch circuit receives preset signals from the first control pin and the second control pin within a duration. Particularly, the mode-switch circuit can be connected to the clock pin so as to receive the preset signals which are based on a discrete time scheme determined by the clock pin. In order to convert the driving device from the display mode into the non-display mode, the preset signals aforementioned can be a first signal received by the second control pin and a second signal followed by the first signal and received by the first control pin. On the other hand, in order to convert the driving device from the non-display mode into the display mode, the preset signals can be a first signal received by the second control pin and an unchanged second signal continuously received by the first control pin within the duration.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
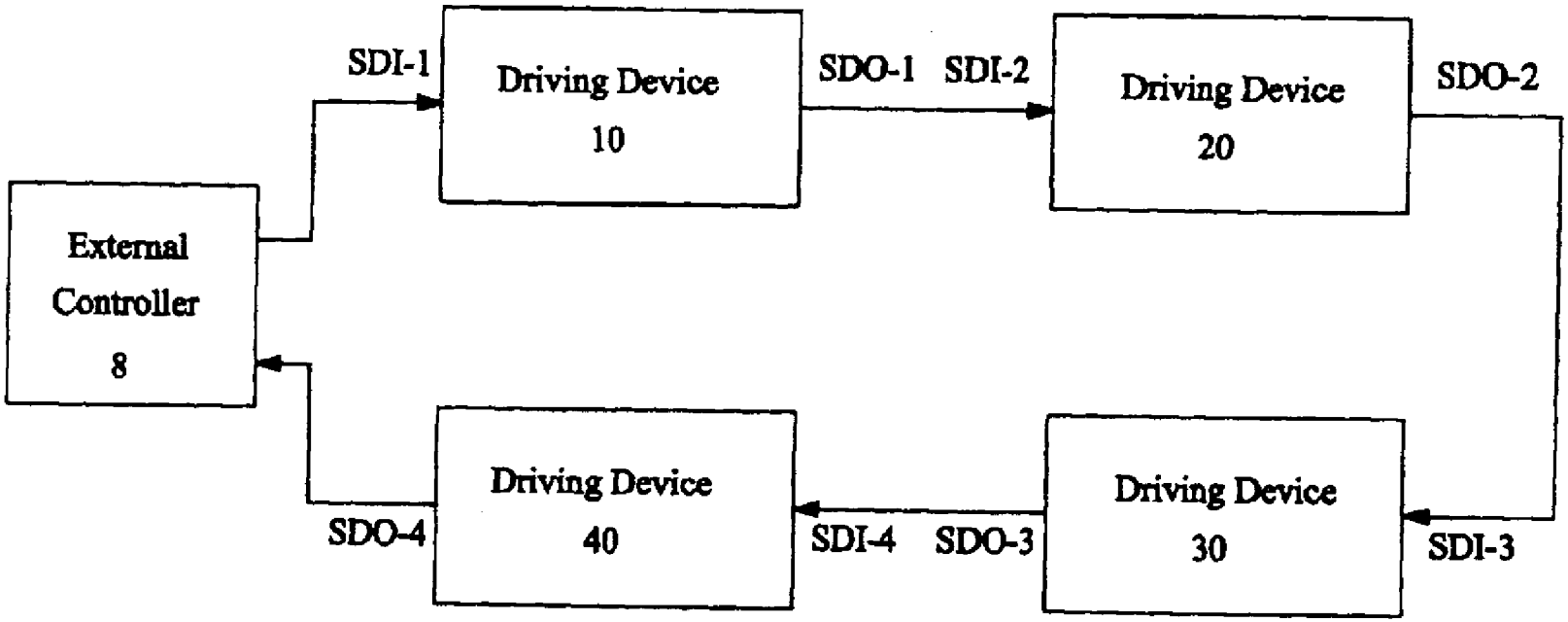
FIG. 1 shows the driving set of the preferred embodiment in accordance with the present invention.

FIG. 1 shows a driving set 1 of a preferred embodiment in accordance with the present invention. In this embodiment, the driving set 1 is composed of four similar driving devices of eight bits, marked as items 10, 20, 30 and 40. The driving devices 10, 20, 30, 40 are connected in cascade to drive a 4×8 LED array. The driving set 1 is connected to an external controller 8 to form a loop, wherein the controller 8 can perform general functions such as coding, etc.

Figure 2:
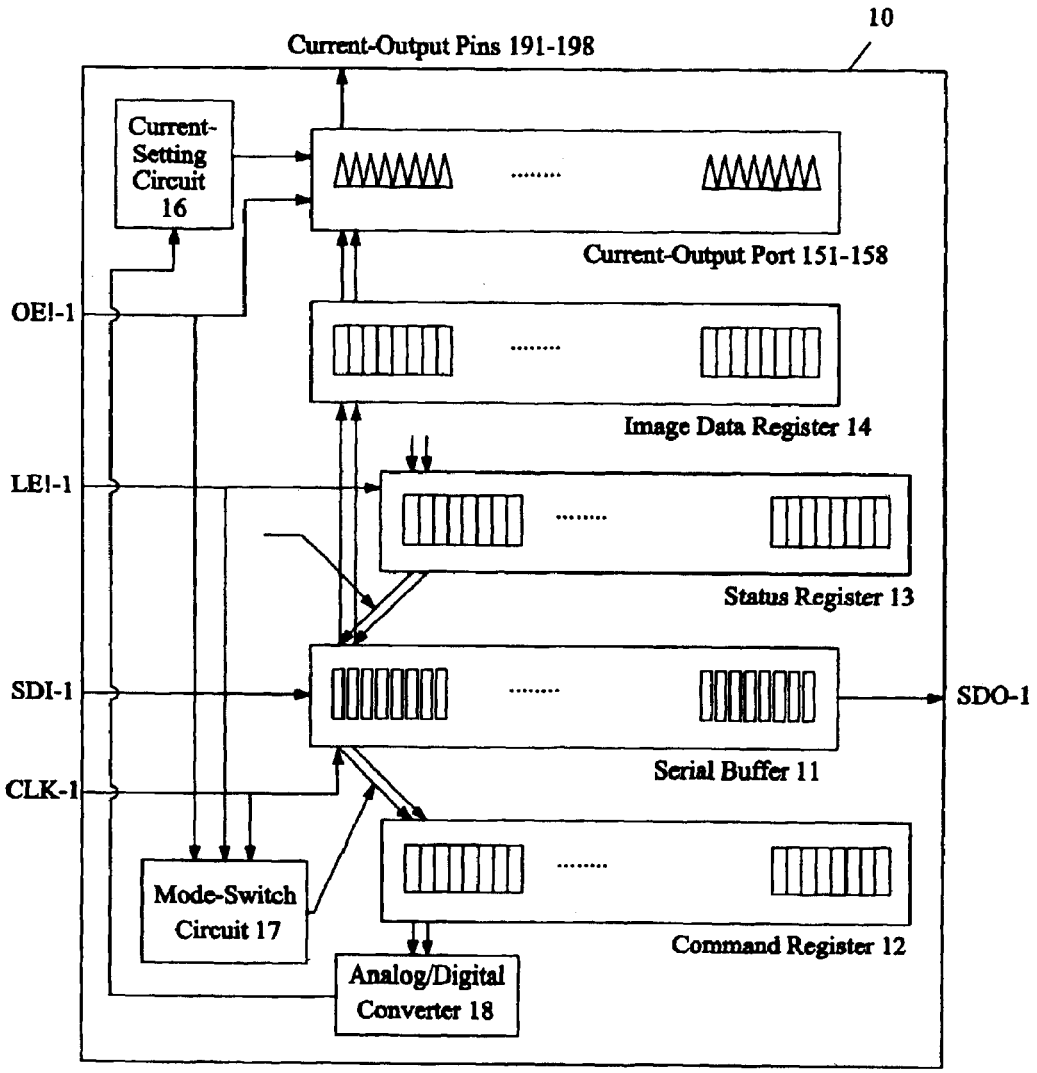
FIG. 2 shows the internal connection of the driving device in accordance with the present invention.

FIG. 2 shows an internal structure of the driving device 10, in which a serial buffer 11 of eight bits, a command register 12 of four bits, a status register 13 of four bits, an image data register 14 of eight bits, eight current-output ports 151–158, a current-setting circuit 16, a mode-switch circuit 17, an analog/digital converter 18, eight current-output pins 191–198, a clock pin CLK-1, a serial-data-in pin SDI-1, a serial-data-out pin SDO-1, a latch-enable pin LE!-1 and an output-enable pin OE!-1 are included. For all of the driving devices, the clock pins are commonly controlled by a set of synchronous signal sources.

When the driving device 10 works in the display mode, according to the content in the image data register, the output ports 151–158 are at least capable of lighting the LEDs respectively through the correspondent output pins. That is, clock signals are sent to the serial buffer 11 through the clock pin CLK-1 and make image and/or command and/or status data to be serially shifted to and out from the serial buffer 11 through the SDI-1 pin and the SDO-1 pin. In display mode, the serial data primarily include only image data. These image data will be transferred in parallel from the serial buffer 11 to the image data register 14 in a moment of a latch-enable signal received by the pin LE!-1. These image data will be further transferred from the image data register 14 to the current-output ports 151–158. The pin OE!-1 enables the current-output ports 151–158 to deliver driving current to the correspondent current-output pins 191–198 from the current-setting circuit 16, and then the correspondent LEDs can be lit.

The above functions performed in the display mode are also well known for traditional driving devices. However, in the present invention, additional functions, command transfer and status feedback, can be further exhibited in the non-display mode and no additional pin is required. The pins LE!-1 and OE!-1 are to determine time for switching the driving device between the display mode and the non-display mode. In this embodiment, a synchronous method is applied, in which the pins LE!-1, OE!-1 and CLK-1 are individually connected to the mode-switch circuit 17 as shown in FIG. 2. The pin CLK-1 provides a time unit T for counting based on a discrete time scheme.

Figure 3:
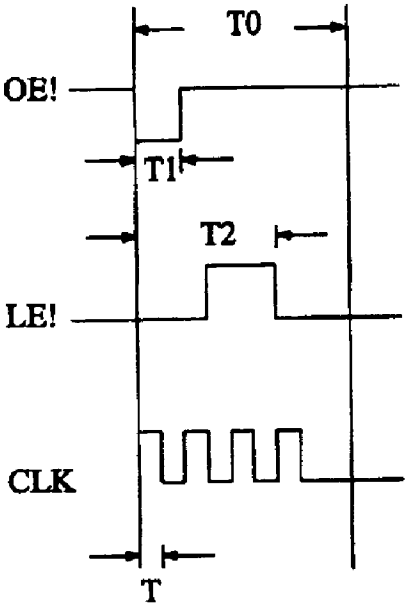
FIG. 3 shows a preset sequence for determining the driving device to enter the non-display mode from the display mode.
Figure 5:
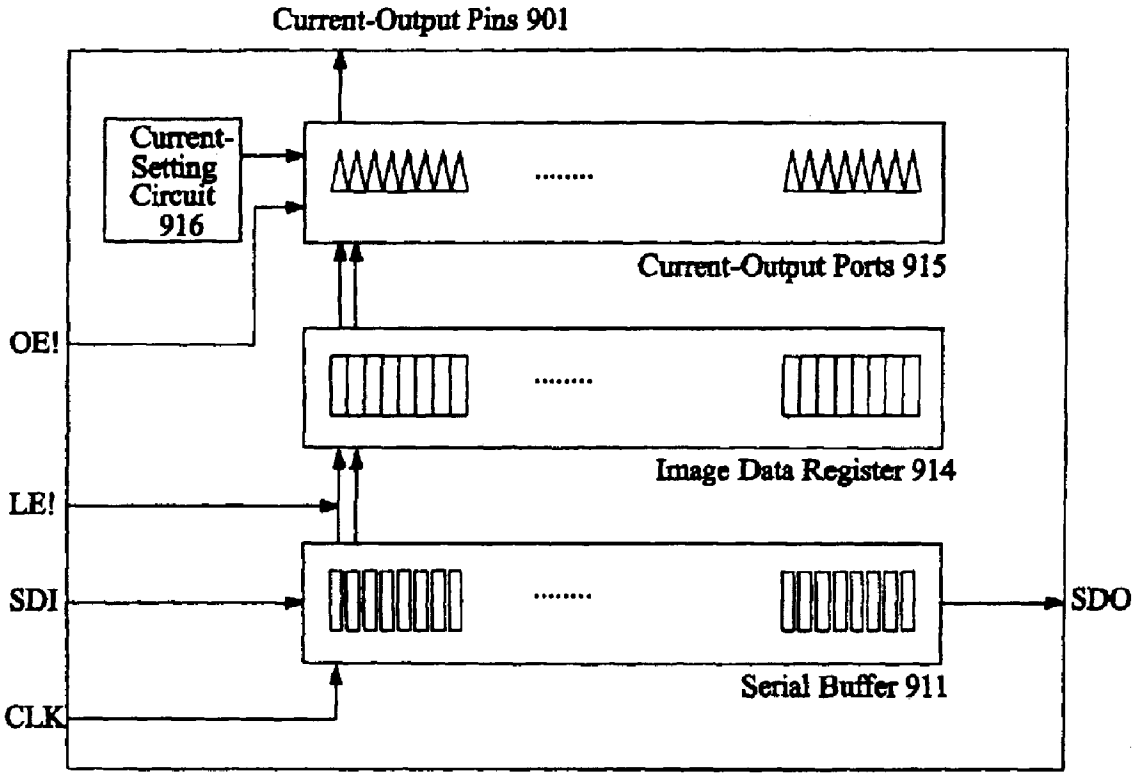
FIG. 5 (Prior Art)
FIG. 5 shows the internal connection of the traditional driving device.

FIG. 3 shows a preset sequence for determining the driving device 10 to enter the non-display mode from the display mode. In this sequence, two stages, which occur within a duration T0, are considered.

1) When a first preset signal with a pulse width T1 is received by the pin OE!, the driving device 10 enters the first stage.

2) After entering the first stage, a second preset signal with a pulse width T2 received by the pin LE! indicates that the second stage is completed, and the driving device 10 enter the non-display mode from the display mode.

When entering the non-display mode, the command register 12, the status register 13 and the mode-switch circuit 17 are enabled.

For one of several possible situations, anyone of LEDs might not be lit, and the mode-switch circuit 17 may send a signal as a trigger to make the status register 13 transfer internal statuses of the driving device 10 to the serial buffer 11. Such status information will be finally sent to the external controller 8 through the pin SDO-1 and the driving devices 20–40, whereby an operator may take action if the status information indicates that corrective action is necessary. In this situation, the serial data primarily include the status and image data.

As for another possible situation that an LED might be lit, but not as brightly as expected, the external controller 8 may send a command to the serial buffer 11, and then the mode-switch circuit 17 may send another signal as a trigger to make the serial buffer 11 transfer the command to the command register 12. In this embodiment, the command, containing a gain value, can be further sent to the current-setting circuit 16 through an analog/digital converter 18, whereby output of the correspondent current-output ports 151–158 can be determined by the gain value.

Figure 4:
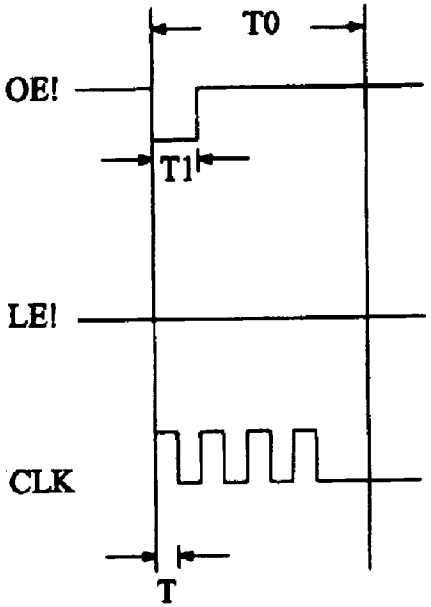
FIG. 4 shows another preset sequence for determining the driving device to enter the display mode from the non-display mode.

FIG. 4 shows another preset sequence for causing the driving device to enter the display mode from the non-display mode. In this sequence, two stages, which occur within the duration T0, are considered.

1) When a first preset signal with a pulse width T1 is received by the pin OE!, the driving device 10 enters the first stage.

2) After entering the first stage, an unchanged second preset signal continuously received by the pin LE! within T0 indicates that the second stage is completed, and the driving device 10 quits the non-display mode and returns to the display mode.

In the present invention, the pulse widths T1 and T2 are short enough, for example, about 1/30 second, which cannot be perceived by human eyes. Therefore, switching between the display mode and the non-display mode is acceptable. Additionally, since the sequence shown in FIG. 3 is seldom used to drive the display devices, its impact upon the visual effect can be ignored.

The above description illustrates internal connection and operation of the driving device 10. In common use, driving sets such as that shown in FIG. 1 are provided. In FIG. 1, serial data are sent through the pins SDI-1 and SDO-1 of the driving device 10, the pins SDI-2 and SDO-2 of the driving device 20, . . . , the pins SDI-4 and SDO-4 of the driving device 40, finally to the external controller 8.

The driving device of the present invention can further include a circuit for detecting malfunctions of the current-output ports. The statuses can be transferred to the status register for feedback as described above in the non-display mode.

According to the present invention, additional functions, command transfer and status feedback, can be enabled without adding extra signal pins to the driving device. Furthermore, the driving set composed of the driving devices in cascade can be applied to the display devices in practice.

What is claimed is:

1. A set of devices for driving display devices, wherein each of said driving devices comprises a serial buffer, a serial-data-in (SDI) pin to receive image data, a serial-data-out (SDO) pin to transfer image data, and a clock pin operable to selectively cause image and/or command and/or status data to be serially shifted in to and out from said serial buffer through said SDI pin and said SDO pin; and said driving devices are connected in cascade and sequentially defined as driving device 1, driving device 2, through driving device P-1, and driving device P, where P is an integer larger than 1; wherein: said SDI pin of said driving device 1 further receives command from an external controller, and said SDO pin thereof further transfers command and/or internal status of said driving device 1; said SDI pin of said driving device 2 further receives command and/or status from said SDO pin of said driving device 1, and said SDO pin thereof further transfers command and/or internal status of said driving devices 1 and 2; Repeating the command and status transfer for the set of devices through P-1; said SDI pin of said driving device P further receives command and/or status from said SDO pin of said driving device P-1; and said clock pins are all commonly controlled by a set of synchronous signal sources.

2. A set of devices for driving display devices, wherein each of said driving devices comprises a serial buffer, a serial-data-in (SDI) pin to receive image data, a serial-data-out (SDO) pin to transfer image data, and a clock pin operable to selectively cause image and/or command and/or status data to be serially shifted in to and out from said serial buffer through said SDI pin and said SDO pin; and each of said driving devices is connected in cascade and sequentially defined as driving device 1, driving device 2, through driving device P-1, and driving device P, where P is an integer larger than 1; wherein: said SDI pin of said driving device 1 further receives command from an external controller, and said SDO pin thereof further transfers command and/or internal status of said driving device 1; said SDI pin of said driving device 2 further receives command and/or status from said SDO pin of said driving device 1, and said SDO pin thereof further transfers command and/or internal status of said driving devices 1 and 2; Repeating the command and status transfer for the set of device through P-1; said SDI pin of said driving device P further receives command and/or status from said SDO pin of said driving device P-1, and said SDO pin thereof further transfers internal status of said driving devices 1 through P to said external controller; and said clock pins are all commonly controlled by a set of synchronous signal sources.

3. A device for driving a display device, capable of working in a display mode in which the function of lighting said display device is performed, and in a non-display mode in which a function other than lighting said display device is performed, wherein said driving device comprises a serial buffer of N bits, at least one extended register of K bits, an image data register of N bits, N output ports, an output-setting circuit, N output pins, a clock pin, a serial-data-in (SDI) pin, a serial-data-out (SDO) pin, a first control pin and a second control pin, where N is an integer larger than 1 and K is an integer less than or equal to N; wherein: said output-setting circuit and said image data register are connected to said output ports; said extended register, when enabled by a correspondent signal in said non-display mode, transfers status of said driving device to said serial buffer and/or receives command from said serial buffer, wherein said command is sent from an external controller; each of said output pins is connected to a respective one of said output ports so as to drive a correspondent display device; said SDI pin is connected to said serial buffer so as to receive image data and further receive commands and/or statuses; said SDO pin is connected to said serial buffer so as to transfer image data and further transfer commands and/or statuses; said clock pin is operable to receive clock signals from the controller to selectively cause image and/or command and/or status data to be serially shifted in to and out from said serial buffer through said SDI pin and said SDO pin; said first control pin is operable to trigger said serial buffer to transfer data in parallel to said image data register; said second control pin is operable to enable said output ports to deliver driving energy, electrical current or voltage, to the output pins.

4. The device of claim 3, wherein said extended register is a status register capable of transferring the status of said driving device to said serial buffer in said non-display mode.

5. The device of claim 4, which further comprises a detecting circuit for detecting current states and/or voltage states of said output ports and then transferring said correspondent statuses to said status register.

6. The device of claim 3, wherein said extended register is a command register capable of receiving the command from said serial buffer in said non-display mode.

7. The device of claim 6, wherein said command register further transfers said command, containing a gain value, to said output-setting circuit through an analog/digital converter, whereby output current and/or voltage of said output port is determined by said gain value.

8. The device of claim 3, wherein said correspondent signal for enabling said extended register is sent from a mode-switch circuit, while said mode-switch circuit receives preset signals from said first control pin and said second control pins within a duration.

9. The device of claim 6, wherein said mode-switch circuit is further connected to said clock pin so as to receive said preset signals within a duration based on a discrete time scheme determined by said clock pin.

10. The device of claim 6, wherein said preset signals comprises a first signal received by said second control pin, and a second signal followed by said first signal and received by said first control pin, and thus said driving device is converted from said display mode into said non-display mode.

11. The device of claim 6, wherein said preset signals comprises a first signal received by said second control pin, and an unchanged second signal continuously received by said first control pin within said duration, and thus said driving device is converted from said non-display mode into said display mode.

12. A set of devices for driving display devices, wherein said set comprises P devices as claimed in claim 3, which are connected in cascade and sequentially defined as driving device 1, driving device 2 through driving device P-1, and driving device P; wherein: P is an integer larger than 1; said SDI pin of said driving device 1 receives image data and/or command from an external controller, and said SDO pin thereof transfers image data and/or command and/or internal status of said driving device 1; said SDI pin of said driving device 2 receives image data and/or command and/or status from said SDO pin of said driving device 1, and said SDO pin thereof transfers image data and/or command and/or internal status of said driving devices 1 and 2 Repeating the process of receiving and transferring of image device and/or image data and/or command and/or internal status for device through P-1, said SDI pin of said driving device P receives image data and/or command and/or status from said SDO pin of said driving device P-1, and said clock pins are all commonly controlled by a set of synchronous signal sources.

13. The set of devices as claimed in claim 12, wherein said SDO pin of said driving device P further transfers internal status of said driving devices 1, 2 through P to said external controller.

* * * * *